US008148298B2

(12) United States Patent
Kutami et al.

(10) Patent No.: US 8,148,298 B2
(45) Date of Patent: Apr. 3, 2012

(54) METHOD FOR CLEANING REVERSIBLE THERMOSENSITIVE RECORDING MEDIUM, AND IMAGE PROCESSING METHOD

(75) Inventors: Atsushi Kutami, Numazu (JP); Makoto Yamamoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 670 days.

(21) Appl. No.: 11/729,743

(22) Filed: Mar. 29, 2007

(65) Prior Publication Data

US 2007/0232490 A1 Oct. 4, 2007

(30) Foreign Application Priority Data

Mar. 29, 2006 (JP) ..... 2006-090063

(51) Int. Cl.
*B41M 5/30* (2006.01)
*B41M 5/42* (2006.01)

(52) U.S. Cl. ..... 503/201

(58) Field of Classification Search ..... None
See application file for complete search history.

(56) References Cited

U.S. PATENT DOCUMENTS

| | | | | |
|---|---|---|---|---|
| 5,278,128 | A | 1/1994 | Hotta et al. | |
| 5,283,220 | A | 2/1994 | Kawaguchi et al. | |
| 5,395,815 | A | 3/1995 | Ikeda et al. | |
| 5,700,746 | A | 12/1997 | Kutami et al. | |
| 5,782,254 | A | 7/1998 | Tanikawa et al. | |
| 5,801,743 | A | 9/1998 | Itoh et al. | |
| 5,837,348 | A | 11/1998 | Watanabe et al. | |
| 5,869,421 | A | 2/1999 | Kutami et al. | |
| 5,869,422 | A | 2/1999 | Kazumi et al. | |
| 5,968,301 | A | 10/1999 | Murakami et al. | |
| 6,096,683 | A | 8/2000 | Amano et al. | |
| 6,154,243 | A | 11/2000 | Tatewaki et al. | |
| 6,174,836 | B1 | 1/2001 | Hotta et al. | |
| 6,177,383 | B1 | 1/2001 | Amano et al. | |
| 6,380,410 | B1 * | 4/2002 | Oftring et al. | 554/149 |
| 6,736,857 | B2 * | 5/2004 | Chang et al. | 8/115.51 |
| 7,223,522 | B2 * | 5/2007 | Sampei | 430/271.1 |
| 7,790,667 | B2 * | 9/2010 | Boeckh et al. | 510/475 |
| 2001/0044553 | A1 * | 11/2001 | Kabashima et al. | 560/157 |
| 2004/0086308 | A1 | 5/2004 | Kobayashi et al. | |
| 2005/0014645 | A1 | 1/2005 | Shimbo et al. | |
| 2005/0170961 | A1 | 8/2005 | Kuboyama et al. | |
| 2006/0063671 | A1 | 3/2006 | Kutami et al. | |
| 2007/0225163 | A1 | 9/2007 | Shimbo et al. | |

FOREIGN PATENT DOCUMENTS

CN 1608859 A 4/2005

(Continued)

OTHER PUBLICATIONS

Jun. 12, 2009 Chinese official action (and English translation thereof) in connection with a counterpart Chinese patent application No. 200710089008X.

(Continued)

*Primary Examiner* — Bruce H Hess
(74) *Attorney, Agent, or Firm* — Cooper & Dunham LLP

(57) ABSTRACT

To provide a method for cleaning a reversible thermosensitive recording medium containing cleaning a reversible thermosensitive recording medium with a cleaning solution which contains at least one of an anionic surfactant and a nonionic surfactant, wherein the reversible thermosensitive recording medium contains an electron-donating coloring compound and an electron-accepting compound and reversibly changes any one of transparency and color tone depending on temperature.

10 Claims, 4 Drawing Sheets

FOREIGN PATENT DOCUMENTS

| | | | |
|---|---|---|---|
| EP | 0574879 | A1 | 12/1993 |
| EP | 0891875 | A2 | 1/1999 |
| EP | 1020771 | A2 | 7/2000 |
| JP | 02-188294 | * | 7/1990 |
| JP | 6-210957 | | 8/1994 |
| JP | 06-210957 | * | 8/1994 |
| JP | 7-068978 | | 3/1995 |
| JP | 7-112584 | | 5/1995 |
| JP | 8-29852 | | 3/1996 |
| JP | 2545025 | | 7/1996 |
| JP | 2597534 | | 1/1997 |
| JP | 9-58142 | | 3/1997 |
| JP | 2002-170087 | | 6/2002 |
| JP | 2004-223782 | | 8/2004 |
| JP | 2005-178140 | | 7/2005 |

OTHER PUBLICATIONS

Aug. 2, 2007 European search report in connection with corresponding European patent application No. EP 07 10 5084.

Sep. 6, 2010 Japanese official action in connection with counterpart Japanese patent application.

* cited by examiner

METHOD FOR CLEANING REVERSIBLE THERMOSENSITIVE RECORDING MEDIUM, AND IMAGE PROCESSING METHOD

BACKGROUND

1. Technical Field

This disclosure relates to a method for cleaning a reversible thermosensitive recording medium, and an image processing method.

2. Description of the Related Art

A data carrier for a tag for process quality control, and physical distribution management in an industrial plant is widely used to record and manage various information characterizing an object such as serial number, and location information of an object, and is in greater need along with informatization of society. However, the increase of the used amount of the data carrier leads to large amount of waste, when the data carriers are disposed of. This is a considerable problem, nowadays the downsizing the total amount of waste is one of the huge social issues.

The data carriers such as a wireless tag, a transponder, a RFID, and a noncontact IC card in card-shaped, in which information is exchanged by electromagnetic wave, have an excellent feature relative to a bar code which optically records information, such that read-writable data even though the data carriers cannot be seen directly in a box such as a corrugated box, and highly secured. Because the information in IC chip cannot be read by a human, it is highly desired to add visual information which can be made out to the data carriers. However, the merit of recycling the data carrier which takes advantage of the characteristics of the electrically rewritable IC chip may be lost when the additional visual information is not rewritten. Thus, Japanese Patent Application Laid-Open (JP-A) Nos. 7-68978, and 2002-170087 disclose that the data carrier is recycled by rewriting optically recorded information using the reversible thermosensitive recording material.

The method for recycling the data carrier with the reversible thermosensitive recording material reduces the quantity of disposal of the data carrier, and is effective to cost-reduction. On the other hand, the once used data carrier must be collected to rewrite information, and rewrite thermally the visual information on the surface of the reversible thermosensitive recording material. These additional works are inevitable. When the data carrier is used for process quality control in assembly plants of devices, the data carrier itself is smeared by dust and oil in the working environment, and marking with a marker or pencil. In case that the smeared reversible thermosensitive recording medium is rewritten, a thermal head may also be smeared, which may cause quality failure in printing, and shorten the printing apparatus life. When the data carrier is repeatedly used, the cleaning of the data carrier is often necessary. Thus, it is necessary to introduce an additional step of cleaning.

The recycle of the data carrier with the reversible thermosensitive recording material proposes in principal environmentally friendly and economical solution, but the working efficacy may be reduced in practice. Thus, the solution for avoiding such problem is strongly desired. The cleaning system including, for example, detergent, the heating system (JP-A Nos. 6-210957, 2004-223872, 9-58142), the brush system (JP-A Nos. 6-127730, 6-203257, 7-282315), and the immersion system (JP-A No. 7-112584) have been taken into consideration.

JP-A No. 6-210957 discloses a method for cleaning a reversible thermosensitive recording medium with a cleaning solution. This proposes the utilization of the color change by phase change, and the cleaning solution does not adversely affect to the recording condition of the reversible thermosensitive recording medium. However, the reversible thermosensitive recording medium may loose its function of forming relatively developed condition and erased condition by the difference of heating temperature and/or cooling rate following to heating using an electron-donating coloring compound and an electron-accepting compound, and a print head of a printer used for print may be eroded, when the commonly used cleaning solution is applied.

In the reversible thermosensitive recording medium the break or bend occurred by the above-described handling grows to cracks, the cleaning solution impinges therein, and then the function of the reversible thermosensitive recording medium is damaged.

BRIEF SUMMARY

In an aspect of this disclosure, there is provided a method for cleaning a reversible thermosensitive recording medium using a cleaning solution capable of removing smear such as oil without impairing the function of the reversible thermosensitive recording medium.

In another aspect of this disclosure, there is provided an excellent method for cleaning a reversible thermosensitive recording medium without (1) reducing the density of the rewritten printing, (2) degrading the density of the rewritten background, (3) malfunction of the thermal head, (4) adversely affecting to cracks, and (5) remaining smear when the smeared reversible thermosensitive recording medium is cleaned with the cleaning solution, and an image processing method using the cleaned reversible thermosensitive recording medium.

The inventors have found that the reversible thermosensitive recording medium can be reused by cleaning efficiently with the cleaning solution containing at least one of an anionic surfactant and a nonionic surfactant without impairing the rewrite function of the reversible thermosensitive recording medium which contains an electron-donating coloring compound and an electron-accepting compound and reversibly changes any one of transparency and color tone depending on temperature.

Additional aspects of this disclosure are summarized hereinbelow.

<1> A method for cleaning a reversible thermosensitive recording medium containing: cleaning a reversible thermosensitive recording medium with a cleaning solution containing at least one of an anionic surfactant and a nonionic surfactant, wherein the reversible thermosensitive recording medium contains an electron-donating coloring compound and an electron-accepting compound and reversibly changes any one of transparency and color tone depending on temperature.

<2> A method for cleaning a reversible thermosensitive recording medium according to <1>, wherein the surfactant is at least one selected from the group consisting of α-olefin sulfonate, alkyl ether sulfate, alkylbenzene sulfonate, alkyl ether phosphate, dialkyl sulfosuccinate, polyoxyethylene alkyl (C12-C15) ether, polyoxyethylene sorbitan fatty acid ester, polyoxyethylene castor oil, polyoxyethylene hydrogenated castor oil, polyglycerin fatty acid ester, and alkyl polyglucoside.

<3> A method for cleaning a reversible thermosensitive recording medium according to <1>, wherein the surfactant is at least one selected from the group consisting of sodium α-olefin sulfonate, sodium polyoxyethylene (n=3)

alkyl (C12-C13) ether sulfate, sodium dodecylbenzenesulfonate, and triethanolamine dodecylbenzenesulfonate.

<4> A method for cleaning a reversible thermosensitive recording medium according to any one of <1> to <3>, wherein the content of the at least one surfactant selected from the anionic surfactant and nonionic surfactant in the cleaning solution is 0.01 mass % to 30 mass %.

<5> A method for cleaning a reversible thermosensitive recording medium according to any one of <1> to <4>, wherein the temperature of the cleaning solution when used is 5° C. to 50° C.

<6> A method for cleaning a reversible thermosensitive recording medium according to any one of <1> to <5>, wherein the contact time of the reversible thermosensitive recording medium with the cleaning solution is 10 seconds to 120 seconds.

<7> A method for cleaning a reversible thermosensitive recording medium according to any one of <1> to <6>, wherein the cleaning solution further contains at least one selected from an additive, a thickener, an anti-foaming agent, and a chelating agent.

<8> A method for cleaning a reversible thermosensitive recording medium according to any one of <1> to <7>, wherein the cleaning solution contains a volatile organic solvent having the boiling point of 120° C. or less.

<9> A method for cleaning a reversible thermosensitive recording medium according to any one of <1> to <8>, further containing rinsing the cleaned reversible thermosensitive recording medium with water or a mixture of water and a volatile organic solvent having the boiling point of 120° C. or less.

<10> An image processing method containing at least one of forming an image on a reversible thermosensitive recording medium by heating the reversible thermosensitive recording medium, and erasing the image formed on the reversible thermosensitive recording medium by heating the reversible thermosensitive recording medium, wherein the reversible thermosensitive recording medium is cleaned by the method for cleaning the reversible thermosensitive recording medium according to any one of <1> to <9>.

DETAILED DESCRIPTION OF THE INVENTION

Figure 1:
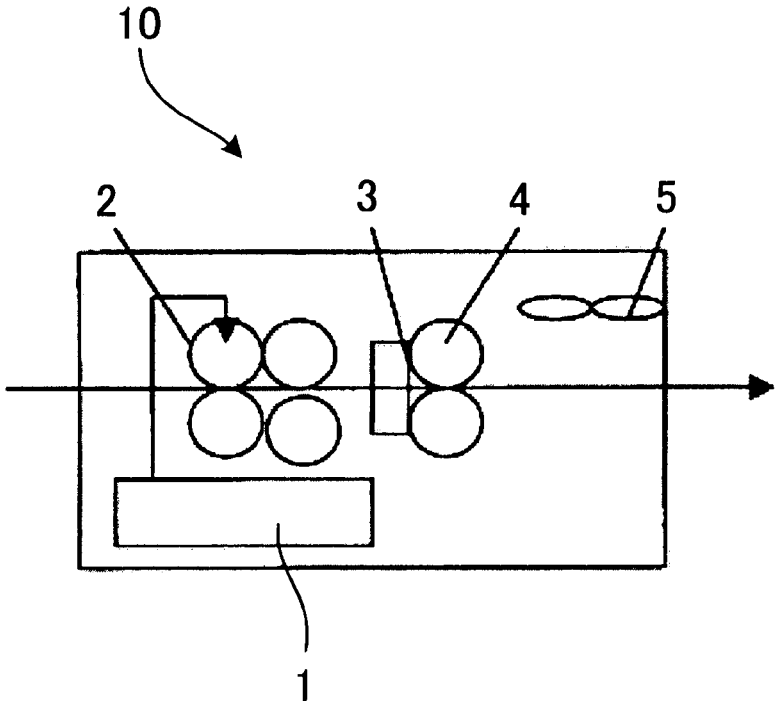
FIG. 1 schematically shows an example of the cleaning apparatus used in Examples of the present invention.

<<Method for Cleaning a Reversible Thermosensitive Recording Medium>>

The method for cleaning a reversible thermosensitive recording medium of the present invention contains at least cleaning step; rinsing step, and further contains other steps as necessary.

<Cleaning Step>

The cleaning step is the step of cleaning the reversible thermosensitive recording medium with a cleaning solution containing at least one of an anionic surfactant and a nonionic surfactant.

[Reversible Thermosensitive Recording Medium]

The reversible thermosensitive recording medium contains a support and at least a thermosensitive recording layer on the support, and further contains a protective layer, an under layer, an intermediate layer, a back layer, and additionally other layers as necessary.

-Thermosensitive Recording Layer-

The thermosensitive recording layer contains at least an electron-donating coloring compound and an electron-accepting compound, also a binder resin and a decoloring enhancer, and further contains the other ingredients as necessary.

The thermosensitive recording layer contains an electron-donating coloring compound (coloring agent) and an electron-accepting compound (color developer), and may reversibly change color depending on the temperature.

The above-noted "reversibly change color depending on the temperature" means a phenomenon in which visible changes are induced reversibly depending on the temperature alternation, in other words, it means that a relatively developed condition and a relatively erased condition may be produced depending on the heating temperature and/or cooling rate following to heating. In this meaning, the visible change may include the change of color condition as well as the change of shape. In the present invention, the materials that may cause the changes of color condition are mainly utilized. The changes of color condition include the changes of transmittance, reflectivity, absorption wavelength, and scattering coefficient. The reversible thermosensitive recording material is actually expressed by the combination of these changes. The reversible thermosensitive recording material is not particularly limited and may be appropriately selected depending on the intended purpose, provided that the transparency and/or color tone may reversibly change depending on the temperature. Specifically, such materials are also exemplified that the first color condition appears at the first specific temperature above ambient temperature, and the second color condition appears when heated to the second specific temperature above the first specific temperature then cooled. Among various materials, the materials that change the color condition at the first specific temperature and at the second specific temperature are preferably used.

As such materials, the material that is transparent at the first specific temperature and white opaque at the second specific temperature (JP-A No. 55-154198), the material that develops a color at the second specific temperature and erases at the first specific temperature (JP-A No. 04-224996, JP-A No. 04-247985, JP-A No. 04-267190 etc.), the material that is white opaque at the first specific temperature and is transparent at the second specific temperature (JP-A No. 03-169590 etc.), the material that develops black, red, blue etc. and erases at the second specific temperature (JP-A No. 02-188293, JP-A No. 02-188294 etc.) may be exemplified.

Figure 5:
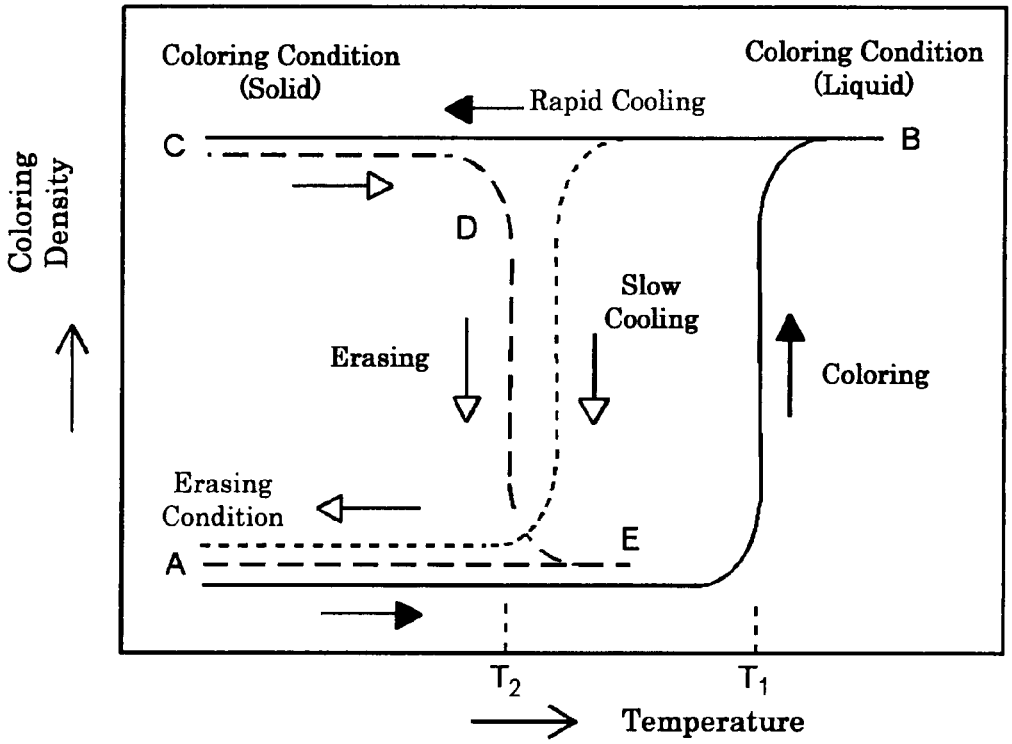
FIG. 5 schematically shows the color developing-reducing property (developing-erasing phenomena) in an example of the reversible thermosensitive recording medium of the present invention.

As discussed above, the reversible thermosensitive recording medium of the present invention may represent a relatively colored condition and a relatively erased condition depending on the heating temperature or cooling rate following to the heating. The essential color developing-erasing phenomenon of the composition, which includes the coloring agent and color developer, will be explained hereinafter. FIG. 5 shows the relation between the coloring density and the temperature in the reversible thermosensitive recording medium. When the recording medium is heated from the initial erased condition (A), the recording medium comes to the melted and coloring condition (B), through an occurrence of coloring at the temperature T1 at which the melting begins. When cooled rapidly from the melted and coloring condition (B), it may be cooled to the room temperature while maintaining the coloring condition, thereby a solid coloring condition (C) emerges. Whether or not the developed condition emerges depends on the cooling rate from the melted condition; the erasing appears when cooled slowly, that is, the initial erased condition (A) or a condition of relatively lower density than rapidly cooled coloring condition (C) emerges. On the other hand, when heated again from rapidly cooled coloring condition (C), erasing occurs at a lower temperature T2 than the developing temperature (D to E); when cooled from this temperature, resulting in the initial erased condition (A). Actual coloring and erasing temperatures may be selected depending on the application since these temperatures vary with the utilized coloring agent and color developer. Further, the coloring density at the melting condition and the coloring density after the rapid cooling may not necessarily coincide, are different significantly in some cases.

In the reversible thermosensitive recording medium, the coloring condition (C) obtained through rapid cooling from the melted condition is a condition in which the coloring agent and color developer are blended such that they may react through molecular contact, and the coloring condition is often solid state. In the condition, the coloring agent and color developer are coagulated to represent a coloring condition. It is believed that the formation of the coagulated condition makes the coloring condition stable. On the other hand, in the erased condition, the coloring agent and color developer are in phase separation. It is believed that the molecules of at least one of the compounds assemble to form domains or crystals in the separated condition, and that the coloring agent and color developer are separated and stabilized through the coagulation or crystallization. In many cases, the phase separation of the coloring agent and the color developer and also the crystallization of the color developer cause the erosion more perfectly. In the erosion due to slower cooling from the melted condition as well as the erosion due to the heating from the coloring condition as shown in FIG. 5, the coagulated structures are altered depending on the temperature, resulting in the phase separation and crystallization of the color developer.

In the reversible thermosensitive recording medium, the coloring record may be formed by heating up to the temperature for melting and mixing by means of a thermal head and the like, then subjecting to a rapid cooling. Further, the erosion may be carried out in two ways: one is to cool slowly from the heated condition; the other is to heat to somewhat lower temperature than the coloring temperature. The two ways are equivalent in that the coloring agent and color developer come to phase separation or they are maintained temporarily at the temperature at which at least one of the coloring agent and color developer crystallizes. The rapid cooling in the formation of the coloring condition is intended not to maintain at the phase-separation or crystallization temperature. By the way, the terms of "rapid" and "slow" cooling represent no more than relative cooling rates with respect to certain composition, and the actual rates alter depending on the combination of the coloring agent and color developer.

-Electron-Donating -

The electron-donating compound (coloring agent) is not particularly limited and may be appropriately selected depending on the intended purpose; leuco dye is preferably used, for example. The leuco dye is not particularly limited and may be appropriately selected depending on the intended purpose; the known dye precursors such as phthalide compounds, azaphthalide compounds, and fluoran compounds are preferred.

Examples of the leuco dyes include 2-anilino-3-methyl-6-diethylaminofluoran, 2-anilino-3-methyl-6-di-(n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-methylamino)fluoran, 2-anilino-3-methyl-6-(N-n-amyl-N-ethylamino)fluoran, 2-anilino-3-methyl-6-(N-n-isoamyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trichloromethylanilino)-3-methyl-6-(N-cyclohexyl-N-methylamino) fluoran, 2-(2,4-dimethylanilino)-3-methyl-6-diethylaminofluoran, 2-(N-ethyl-p-toluidino)-3-methyl-6-(N-ethylanilino)fluoran, 2-(N-ethyl-p -toluidino)-3-methyl-6-(N-propyl-p-toluidino)fluoran, 2-anilino-6-(N-n-hexyl-N-ethylamino)fluoran, 2-xylidino-3-methyl-6-dibutylaminofluoran, 2-(o-chloroanilino)-6-diethylaminofluoran, 2-(o-chloroanilino)-6-dibutylaminofluoran, 2-(m-trifluoromethylanilino)-6-diethylaminofluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 3-diethylamino-6-(m-trifluoromethylanilino)fluoran, 3-(1-ethyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-methyl-4-diethylaminophenyl)-4-azaphthalide, 3-(1-ethyl-2-methylindole-3-yl)-3-(2-methyl-4-diethylaminophenyl)-7-azaphthalide, 3-(1 -ethyl-2-methylindole-3-yl)-3-(4-diethylaminophenyl)-4-azaphthalide, 3-(1-ethyl-2-methylindole-3-yl)-3-(4-N-n-amyl-N-methylaminophenyl)-4-azaphthalide, 3-(1 -methyl-2-methylindole-3-yl)-3-(2-hexyloxy-4-diethylaminophenyl)-4-azaphthalide, 3,3-bis(2-ethoxy-4-diethylaminophenyl)-4-azaphthalide, and 3,3-bis(2-ethoxy-4-diethylaminophenyl)-7-azaphthalide. These may be used alone or in combination.

-Electron-Accepting Compound-

The electron-accepting compound (color developer) is not particularly limited and may be appropriately selected depending on the intended purpose. For example, the compounds having in the molecule one or more structure selected from (i) the structure which affords developing ability for developing the leuco dye (e.g. phenol type hydroxyl group, carboxyl acid group, phosphoric acid group etc.), and (ii) the structure which controls the cohesive property between molecules (the structure with connected long-chain hydrocarbon groups). Further, the connected portions may be intervened by the connecting groups with hetero atom having two or more valence, and the long-chain hydrocarbon group may contain such connecting group and/or aromatic group. Examples of the color developer include those disclosed in JP-A No. 5-124360, 6-210954, 7-179043, 10-95175, 9-290563, and 11-188969.

The mixing ratio of the electron-donating coloring compound (coloring agent) and electron-accepting compound (color developer) is not limited definitely, since the appropriate range is different depending on the utilized compounds. The molar ratio of the color developer to the coloring agent is preferably 0.1/1 to 20/1, and more preferably 0.2/1 to 10/1. The color developer amount of over or under this range may result in a lower coloring density. Further, the coloring agent and color developer may be utilized in an encapsulated condition.

In the thermosensitive recording layer, additives may be incorporated in order to improve and control the coating and developing-erasing properties as necessary. Examples of the additives include a surfactant, a conducting agent, a filler, an antioxidant, and a color stabilizer.

For the binder resin, a resin curable by heat, UV rays, and electron beam is preferably used. The incorporation of the curable resin to the thermosensitive recording layer allows to improve the heat-resistant and coated film strength of the thermosensitive recording layer. Thus, the repeating durability of the reversible thermosensitive recording medium is also improved.

Examples of the resins curable by UV rays, and electron beam include oligomers of urethaneacrylates, epoxyacrylates, polyesteracrylates, polyetheracrylates, vinyls and unsaturated-polyesters; monomers such as mono-functional or multi-functional acrylate, methacrylate, vinylester, ethylene derivatives, and allyl compounds.

When the resin is cured by UV rays, photopolymerization initiator and promoter are preferably added.

Examples of the resins curable by electron beam include those disclosed in JP-A No. 2-566.

The resin curable by heat is not particularly limited, and may be appropriately selected depending on the intended purpose, as long as a cross-linking agent is added thereto. Examples thereof include an acryl polyol resin, a polyester polyol resin, a polyurethane polyol resin, a phenoxy resin, a polyvinyl butyral resin; resins having a group reactive to a cross-linking agent such as cellulose acetate propionate, and cellulose acetate butyrate; and resins copolymerized with monomers having a group reactive to a cross-linking agent and other monomers.

The cross-linking agent is not particularly limited, and may be appropriately selected depending on the intended purpose. Examples thereof include an isocyanate compound, amines, phenols, and an epoxy compound.

The thermosensitive recording layer is formed using a coating solution which is prepared by mixing and dispersing uniformly a mixture composed of a leuco dye, a coloring agent, various additives, a binder resin, and a coating solvent. The solvent used for preparing the coating solution is not particularly limited, and may be appropriately selected depending on the intended purpose; for example, alcohols, ketones, ethers, glycol ethers, esters, aromatic hydrocarbons, aliphatic hydrocarbons and the like.

The coating solution is prepared by using a conventional dispersing apparatus for coating solution known in the art such as a paint shaker, a ball mill, an Atlighter, a three-roll mill, a Kedy Mill, a sand mill, a Dino Mill, and a colloid mill. Each material may be dispersed in a solvent using a dispersing apparatus for coating solution, or each material may be respectively dispersed in a solvent and then mixed. Moreover, each material may be heated and dissolved and then quenched or slowly cooled to be precipitated.

The coating method for forming the reversible thermosensitive recording layer is not particularly limited, and those known in the art may be used depending on the intended purpose. Examples thereof include blade coating, wire bar coating, spray coating, air knife coating, bead coating, curtain coating, gravure coating, kiss coating, reverse roll coating, dip coating, and die coating.

The thickness of the thermosensitive recording layer is not particularly limited, and may be appropriately selected depending on the intended purpose; for example, preferably 1 μm to 20 μm, and more preferably 3 μm to 15 μm.

-Protective Layer-

The protective layer contains at least a binder resin, and further contains other components as necessary.

Examples of the binder resins include a resin curable by heat, UV rays, and electron beam. Of these, the resin curable by UV rays is preferably used.

Examples of the resins curable by UV rays, and electron beam include oligomers of urethaneacrylates, epoxyacrylates, polyesteracrylates, polyetheracrylates, vinyls and unsaturated-polyesters; monomers such as mono-functional or multi-functional acrylate, methacrylate, vinylester, ethylene derivatives, and allyl compounds.

When the resin is cured by UV rays, photopolymerization initiator and promoter are preferably added to the protective layer.

Examples of the resins curable by electron beam include those disclosed in JP-A No. 2-566.

The resin curable by heat is not particularly limited, and may be appropriately selected depending on the intended purpose, as long as a cross-linking agent is added thereto. Examples thereof include an acryl polyol resin, a polyester polyol resin, a polyurethane polyol resin, a phenoxy resin, a polyvinyl butyral resin; resins having a group reactive to a cross-linking agent such as cellulose acetate propionate, and cellulose acetate butyrate; and resins copolymerized with monomers having a group reactive to a cross-linking agent and other monomers.

The cross-linking agent is not particularly limited, and may be appropriately selected depending on the intended purpose. Examples thereof include an isocyanate compound, amines, phenols, and an epoxy compound.

The protective layer can be produced by the dispersing apparatus and coating method described above in the thermosensitive recording layer. The thickness of the protective layer is preferably 0.1 μm to 10 μm.

-Intermediate Layer-

An intermediate layer is preferably disposed between the thermosensitive recording layer and the protective layer, in order to improve the adhesive quality between the thermosensitive recording layer and the protective layer, to prevent the deterioration of the thermosensitive recording layer by coating the protective layer, and to prevent the additive in the protective layer from migrating into the thermosensitive recording layer; thereby the preservability of the coloring images may be improved. Further, a resin with lower oxygen permeability is used for the protective layer and the intermediate layer which are disposed on the thermosensitive recording layer, thereby the oxidation of the color developer and coloring agent in the thermosensitive recording layer can be prevented or reduced. The examples of the intermediate layers include those disclosed in JP-A No. 1-133781.

The intermediate layer contains at least a binder resin, and further contains other components such as a filler and an UV ray absorber as necessary.

The binder resin is not particularly limited, and may be appropriately selected depending on the intended purpose. Examples thereof include a thermoset resin, a thermoplastic resin, a UV curable resin, and a EB curable resin. Specific examples thereof include polyethylene, polypropylene, polystyrene, polyvinyl alcohol, polyvinyl butyral, polyurethane, saturated polyester, unsaturated polyester, an epoxy resin, a phenol resin, a polycarbonate resin, and a polyamide resin.

Examples of the fillers include inorganic fillers and organic fillers. Examples of the inorganic fillers include carbonate, silicate, a metallic oxide, and a sulfated compound. Examples of the organic fillers include a silicone resin, a cellulose resin, an epoxy resin, a nylon resin, a phenol resin, a polyurethane resin, an urea resin, a melamine resin, a polyester resin, a polycarbonate resin, a styrene resin, an acrylic resin, a polyethylene resin, a formaldehyde resin, and a polymethylmethacrylate resin. The content of the filler in the intermediate layer is preferably 1 volume % to 95 volume %, and more preferably 5 volume % to 75 volume %.

Examples of the UV absorbers include the compounds having a structure of salicylate, cyanoacrylate, benzotriazole, and benzophenone.

The content of the UV absorber is preferably 0.5 parts by mass to 10 parts by mass based on 100 parts by mass of the resin.

The solvent and dispersing apparatus for the coating solution of the intermediate layer, the method for coating, drying and curing the intermediate layer can be achieved by the known method described above in the thermosensitive recording layer and protective layer.

The thickness of the intermediate layer is preferably 0.1 μm to 20 μm, and more preferably 0.3 μm to 3 μm.

-Back Layer-

The back layer may be disposed on the support opposite to the reversible thermosensitive recording layer in order to restrain the reversible thermosensitive recording medium from curling caused by shrinkage of the resin used on the surface of the support on which the reversible thermosensitive recording layer is disposed. The back layer contains at least a binder resin, and further contains other components as necessary.

Examples of the binder resins include a resin curable by heat, UV rays, and electron beam. Of these, the resin curable by UV rays is preferably used.

Examples of the resins curable by UV rays, and electron beam include oligomers of urethaneacrylates, epoxyacrylates, polyesteracrylates, polyetheracrylates, vinyls, and unsaturated-polyesters; monomers such as mono-functional or multi-functional acrylate, methacrylate, vinylester, ethylene derivatives, and allyl compounds. When the resin is cured by UV rays, photopolymerization initiator and promoter are preferably added to the back layer.

Examples of the resins curable by electron beam include those disclosed in JP-A No. 2-566.

The resin curable by heat is not particularly limited, and may be appropriately selected depending on the intended purpose, as long as a cross-linking agent is added thereto. Examples thereof include an acryl polyol resin, a polyester polyol resin, a polyurethane polyol resin, a phenoxy resin, a polyvinyl butyral resin; resins having a group reactive to a cross-linking agent such as cellulose acetate propionate, and cellulose acetate butyrate; and resins copolymerized with monomers having a group reactive to a cross-linking agent and other monomers.

The cross-linking agent is not particularly limited, and may be appropriately selected depending on the intended purpose. Examples thereof include an isocyanate compound, amines, phenols, and an epoxy compound.

For the back layer, diluted solvents, organic or inorganic fillers, UV absorbers, lubricants, coloring pigments, and antistatic agents may be added other than the binder resins.

The same organic or inorganic fillers, UV absorbers as described in the intermediate layer can be used.

Examples of the lubricants include synthetic wax, vegetable wax, animal wax, higher alcohols, higher fatty acids, higher fatty acid esters, and amides.

The back layer is disposed for the purpose of restraining shrinkage of the surface of the sheet on which the thermosensitive recording layer is disposed and is preferably coated so as to balance the shrinkage between the surface layer and the back layer, such that the thermosensitive recording sheet is smooth and flat after coating the surface layer and back layer.

An under layer may be disposed in the reversible thermosensitive recording medium to improve color developing sensitivity and adhesive property. An optical thermal conversion layer which absorbs a laser beam and converts the beam to heat may be disposed for enabling laser recording.

Moreover, the reversible recording medium is not particularly limited; for example, a reversible recording medium has a liquid crystal, and a polymer medium film in which droplets containing dichroic pigments are dispersed, which applies the following principles that the liquid crystals are randomly aligned by heating a thermosensitive recording layer while the heated part is colored by randomly aligning the dichroic pigments, on the other hand the liquid crystals are vertically aligned (homeotropic alignment) by applying electric potential at both sides of the recording film and then the color is erased to be transparent, and a heat sensitive coloring reversible recording medium composed of (i) an electron-donating coloring organic compound, (ii) an electron-accepting compound, and (iii) a color changing temperature adjustor which determines the occurrence temperature of color reaction of (i) and (ii), which changes the erased condition to the coloring condition by heating, and coloring condition to the erased condition by cooling.

The reversible thermosensitive recording medium is not particularly limited, and may be formed into various shapes depending on the application; for example, card-like, sheet-like, label-like, roll-like and tag-like shape.

Examples of the applications of the reversible thermosensitive recording medium formed into a card-like shape include a prepaid card, a point card, and a credit card.

The reversible thermosensitive recording medium formed into a sheet-like shape of normal document size such as A4 size may be applied broadly into temporary output applications such as normal document, instructing letter for process quality control, circulation document, and conference data, needless to say trial printings, because the sheet-like shape has wider printable area than the card-like shape, when an printing-erasing apparatus is introduced.

The reversible thermosensitive recording medium formed into a roll-like shape may be applied for display board, notice plate and electronic white board by being integrated into an instrument with a printing-erasing part. Such display instruments may be appropriately utilized in a clean room since dusts and contaminants are not emitted.

The reversible thermosensitive recording medium formed into a tag-like shape which is larger than the card-like shape may be applied for process quality control, shipping instructions, thickets, and the like. The label-like shape may be processed to various sizes, and repeatedly used by adhering to carriages, packages, boxes, and containers for process quality control, and article control.

The reversible thermosensitive recording member contains an information-memorizing part and a reversible displaying part, in which the reversible displaying part contains the reversible thermosensitive recording medium of the invention, and further contains other members as necessary.

The reversibly displayable thermosensitive recording layer and the information-memorizing part are provided in an identical card (integrated), and a part of the memorized information of the information-memorizing part is displayed on the thermosensitive recording layer, thereby the owner of the card may convenient in that the information can be confirmed by only viewing the card without a particular device. Further, in the case that the content of the information-memorizing part is rewritten, the reversible thermosensitive recording medium may be repeatedly utilized by rewriting the display of the reversible thermosensitive recording part.

The member comprising the information-memorizing part and the reversible displaying part may be classified in the following two types: (1) A part of the member having the information-memorizing part is utilized as a support of the reversible thermosetting recording medium, and the thermosensitive recording layer is disposed on the support directly; (2) A reversible thermosensitive recording layer is disposed separately on a support to form a reversible thermosensitive recording medium, and the support is adhered to the member having the information-memorizing part.

In these cases of (1) and (2), the position of the disposed information-memorizing part may be the opposite side of the thermosensitive recording layer on the support of the reversible thermosensitive recording medium, between the support and the thermosensitive recording layer, or on a part of the thermosensitive recording layer, provided that the information-memorizing part and the reversible displaying part are designed to perform their properties.

The information-memorizing part is not particularly limited, and may be formed of a magnetic thermosensitive layer, a magnetic stripe, an IC memory, an optical memory, a RF-ID tag card, a hologram, and the like. In the sheet medium of which the size is over the card size, an IC memory, RF-ID tag are preferably used. The RF-ID tag is composed of an IC chip and an antenna connected to the IC chip.

-RF-ID Tag (IC Tag)-

A noncontact IC tag label is formed such that IC circuit and antenna circuit formed on a circuit board. The IC circuit and antenna circuit are electrically conducted. For base materials of the support used for the circuit board, it is possible to use rigid type materials such as commonly used paper phenol, glass epoxy, and composite; flexible type materials such as polyimide film, polyester film, paper, and synthetic paper; and combination type materials thereof. Examples of the methods for providing with circuit wiring include the method of which a coiled metallic lead wire is arranged on a circuit board using an adhesive, the method of which a film is heated and pressurized to be deformed and then provided on a circuit board, the method of which a lead wire is arranged at a metallic portion in a circuit board with a metal such as copper and aluminum formed thereon is subjected to etching, the method of which circuit wiring is arranged after transferring a metallic foil formed with a conductive metal such as silver to a circuit board, and the method of which a conductive paste coating material is used on a circuit board to print a circuit wiring by means of silk screen printing and drying it to thereby form the circuit wiring.

The noncontact IC tag label is formed by mounting an IC circuit on a circuit board with the circuit wiring arranged thereon and by electrically connecting the IC circuit through to an antenna circuit. The IC circuit is mounted to the circuit board by means of TAB (Tape Automated Bonding), COB (Tip On Board) and Flip Chip mounting. For mounting of the IC circuit and connecting it to an antenna circuit, typically used soldering, and a conductive adhesive can be used, however, in the course of the process, it is required to use the one having temperature conditions under which the circuit board is durable. At that time, to protect the IC circuit and the circuit wiring arranged on the circuit board, an IC circuit layer may be disposed on the IC circuit by packaging it with an epoxy resin or the like. The thickness of the IC circuit layer packaged with an epoxy resin is preferably 150 μm to 1 mm. To protect the IC circuit, a protective film such as a polyimide film and a polyester film may be bound to the exposed surface of the IC circuit.

In the noncontact IC tag label, the adhesive layer, which adheres to the reversible thermosensitive recording medium, or makes a protective film adhere thereto, can be used, provided that the adhesive layer retains adhesive force when layers are laminated and adhered each other during the process for producing the IC tag label. Normally, the adhesive layer can be pressed and adhere at room temperature or heated condition. For example, a common heat sealer such as EVA adhesives can be used. Examples of the main components of the adhesive layer include a natural rubber, a synthetic rubber, an acrylic material, a silicone material, an urethane material, a S—I—S-block polymer material, and an EVA material. These may be used by mixing depending on the application, and various additives may be added. In addition, the adhesive strength of the adhesive layer can be set as necessary. The adhesive layer can retain the adhesive strength in fine folds on the surface of the substrate to some extend, so that the noncontact IC tag is easily put on and taken off, and can be repeatedly used. The adhesive layer, which has the strong adhesive strength and hardly peels after disposed, can be used semipermanently.

In the reversible noncontact IC tag label with visible information, a separable sheet such as a pattern may be disposed on the surface having adhesion or cohesion as necessary.

The surface of the noncontact IC tag label other than the adhesive surface may be processed to be, for example, easily adhesive, water repellent, oil repellent, and antistatic as necessary. The kinds and thickness of the adhesive layer (coated layer) of the noncontact IC tag label can be appropriately selected depending on the kinds of adherend, the environment, and the adhesive strength. The adhesive layer can be formed by coating and drying the common aqueous or solvent adhesive.

Examples of the adhesives include materials of natural rubbers, synthetic rubbers, and acrylics. These adhesives can be used in an organic solvent, and the water dispersed form such as dispersion and emulsion.

The adhesive layer or tacky layer of the IC tag label is disposed on the side of IC circuit in order not to be influenced by the unevenness of the IC circuit.

The protection film of the IC tag label may form a protective layer for the reversible thermosensitive recording medium to have lubricity.

In addition, a thermosensitive layer, a reversible thermosensitive layer, an inkjet layer, a printing layer may be optionally disposed in the IC tag label.

The IC tag label is preferably a sheet-like shape because it is used with adhering on the reversible thermosensitive recording medium. It is more preferably label-processed across the full-width of whole thermal head.

Moreover, the length of the IC tag label is not particularly limited, provided that the IC tag label formed of a magnet or rubber-processed with adhesion has the width equal to or more than that of the thermal head.

As long as the transportation is not effected, the length of the IC tag label may be 10% shorter than the length of the thermal head, preferably 8% shorter, more preferably 6% shorter, and particularly preferably 4% shorter.

In the IC tag label, the antenna part, and IC chip may have projection and be uneven, but preferably have no projection, and smooth surface.

In case that the IC tag label composed of a common antenna part and IC chip is adhered to a metal surface, magnetic flux is blocked off by the metal, and the electromotive force cannot be obtained sufficiently.

Thus, examples of the IC tag labels include the IC tag label composed of high magnetic permeability core and antenna coil, and the IC tag label composed high magnetic permeability core, antenna coil and conductive metal. This type of the IC tag label is advantageously applied to the sheet because electromotive force can be sufficiently obtained by using it to a metal surface, in spite of the difficulty in making it into a thin film. The antenna part and the IC chip are preferably located in different positions rather than in the same position, so that the sheet has a different stiffness and the adhesion is diversified.

Figure 6:
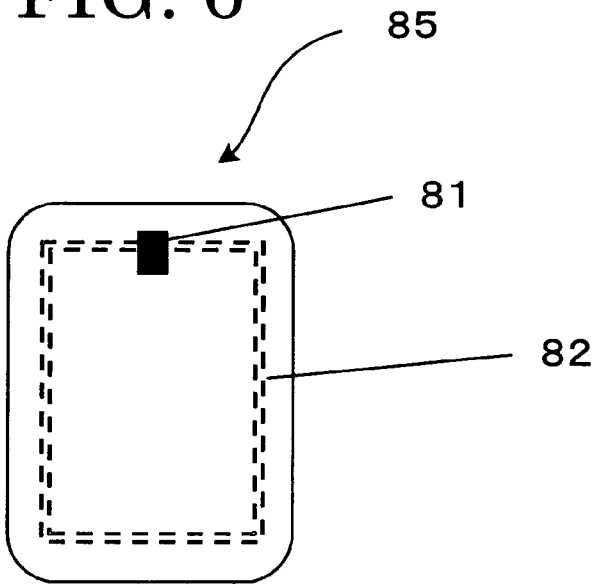
FIG. 6 schematically shows an example of a RF-ID tag.

FIG. 6 schematically shows RF-ID tag 85. The RF-ID tag 85 is composed of IC chip 81, and antenna 82 connected to the IC chip. The IC chip 81 is divided into four parts of memorizing part, power supply controlling part, transmitting part and receiving part; the respective parts are imposed on individual roll, and communication is carried out. The communication is achieved through exchanging data using electric waves by means of the antennas of RF-ID tag and the reader-writer. Specifically, there are two types: an electromagnetic induction type that the antenna of RF-ID receives electric waves from the reader-writer to cause an electromotive force through an electromagnetic induction due to a resonance effect; an electric wave type activated by radiation electromagnetic field. In both cases, the IC chip in the RF-ID tag is activated by the external electromagnetic field, the information in the chip is turned into signals, followed by the dispatch of the signals from the RF-ID tag. The information is received by the antenna of the reader-writer and recognized it by a data processing apparatus, and then the data is processed in a software.

Figure 7:
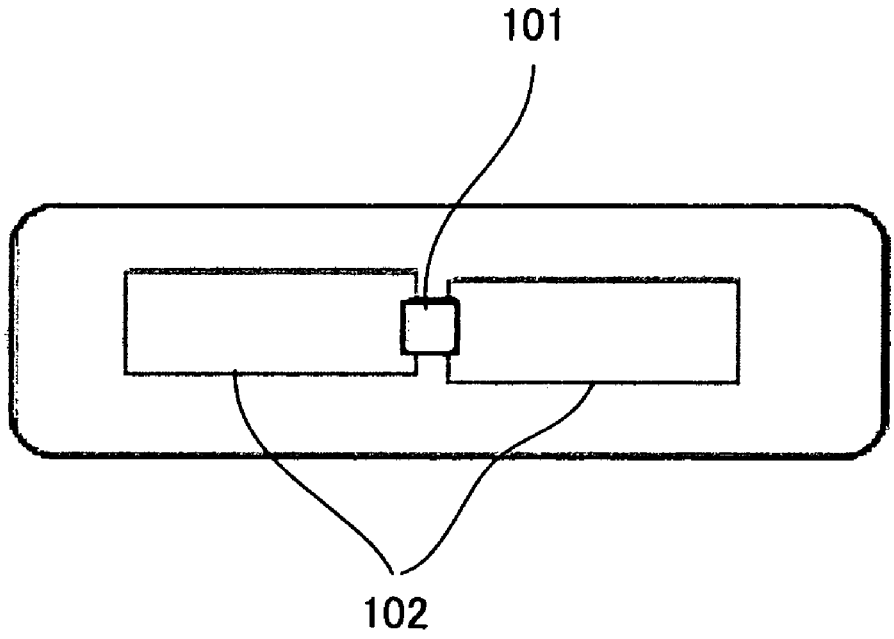
FIG. 7 schematically shows an example of a UHF tag.

FIG. 7 schematically shows an example of a UHF tag, and 101 and 102 respectively denote an IC chip and an antenna.

[Cleaning Solution]

The cleaning solution used for the method for cleaning the reversible thermosensitive recording medium of the present invention is an aqueous solution containing at least any one of an anionic surfactant and a nonionic surfactant. This is because a cationic surfactant and an amphoteric surfactant erode metals, and a thermal head may be damaged.

Examples of the anionic surfactants include a carboxylic anionic surfactant, a sulfate anionic surfactant, a sulfonate anionic surfactant, and a phosphate anionic surfactant.

Specifically, the anionic surfactant which poorly penetrates into the reversible thermosensitive recording medium is preferable. Examples thereof include α-olefin sulfonate, alkyl ether sulfate, disalt alkylsulfosuccinate, alkylbenzene sulfonate, alkyl ether phosphate, and dialkyl sulfosuccinate. Specific examples thereof include sodium α-olefin sulfonate, sodium polyoxyethylene (n=3) alkyl (C12-C13) ether sulfate, sodium dodecylbenzenesulfonate, triethanolamine dodecylbenzenesulfonate, polyoxyethylene (n=2) lauryl ether phosphate, sodium dioctyl sulfosuccinate, and sodium lauryl phosphate. These may be used alone, or in combination.

Examples of the nonionic surfactants include an ether ester nonionic surfactant, a polyalcohol nonionic surfactant, a polyether modified silicone nonionic surfactant, a block polymer nonionic surfactant, and a fluorine-containing nonionic surfactant.

Of these, the ether ester nonionic surfactant, the polyalcohol nonionic surfactant, and the polyether modified silicone nonionic surfactant are particularly preferable because of excellent durability and less crack deterioration in the reversible thermosensitive recording medium.

Examples of the ether ester nonionic surfactants include polyoxyethylene lauryl ether, polyoxyethylene Stearyl ether, polyoxyethylene oleyl ether, polyoxyethylene alkylphenyl ether, polyoxyethylene fatty ester, polyoxyethylene sorbitan fatty acid ester, polyoxyethylene castor oil, polyoxyethylene hydrogenated castor oil, and polyoxyethylene fatty acid.

Examples of the polyalcohol nonionic surfactants include propylene glycol fatty acid ester, glycerin fatty acid ester, polyglycerin fatty acid ester, sorbitan fatty acid ester, sucrose fatty acid ester, and alkyl polyglucoside.

Specific examples of the noionic surfactants include polyoxyethylene (n=40) lauryl ether, polyoxyethylene (n=40) hydrogenated castor oil, decaglycerine monolaurate, polyoxyethylene (n=20) sorbitan monooleate, polyoxythylene (n=20) oleyl ether, and lauryl glucoside. These may be used alone, or in combination.

The content of the at least one of the anionic surfactant and nonionic surfactant in the cleaning solution is preferably 0.01 mass % to 30 mass % of actual concentration, and more preferably 0.1 mass % to 5 mass %. When the content is more than 30 mass %, it is difficult to rinse due to the increased viscosity, and the reverse thermosensitive recording medium adheres each other due to the sticky surface. When the content is less than 0.01 mass %, the cleaning ability may be reduced.

An additive, a thickener, an anti-foaming agent, a chelating agent, an organic solvent, and a pH adjustor can be added to the cleaning solution as necessary.

The pH of the cleaning solution adversely affects to the thermosensitive recording medium, even though it is either at acidic pH or at alkaline pH. The effect of the pH causes not the erasure or reduction of the density of the recorded image, but peeling the surface or darkening the whole reversible thermosensitive recording medium, which is assumed that the problem of the protective layer on the surface of the reversible thermosensitive recording medium. Therefore, the pH of the cleaning solution is preferably 5 to 9, and more preferably 6 to 8. With the solution of the such pH, the reversible thermosensitive recording medium is cleaned without reducing the printed image of the reversible thermosensitive recording medium and background function, or degrading the surface, and the reversible thermosensitive recording medium can be used repeatedly 500 times or more.

Examples of the acid pH adjustors include hydrochloric acid, sulfuric acid, acetic acid, citric acid, lactic acid, and gluconic acid. Examples of the alkaline pH adjustors include diisopropanolamine, sodium hydrate, potassium hydrate, ammonia water, monoethanolamine, diethanolamine, triethanolamine, monoisopropanolamine, diisopropanolamine, and triisopropanolamine.

When the cleaning solution is used, the temperature is preferably 5° C. to 50° C., and more preferably 20° C. to 50° C. When the temperature is lower than 5° C., cleaning ability may be reduced. When the temperature is higher than 50° C., the penetration of the cleaning solution to the reversible thermosensitive recording medium may be accelerated, and then the function of erasing the printed image may be reduced.

The addition of the thickeners to the cleaning solution is a preferred embodiment, because the thickener prevents re-contamination. Examples of the thickeners include a cross-linked acrylic acid polymer, polyvinyl alcohol, polyvinyl pyrrolidone, and carboxymethylcellulose. Of these, the cross-linked acrylic acid polymer is particularly preferable.

The content of the thickener in the cleaning solution is preferably 0.02 mass % to 5 mass %, and more preferably 0.05 mass % to 1 mass %.

To suppress foaming of the surfactant, the anti-foaming agent is preferably added to the cleaning solution. Examples of the anti-foaming agents include aliphatic acids, higher alcohols, and silicones. The content of the anti-foaming agent in the cleaning solution is preferably 0.0001 mass % to 5 mass %, and more preferably 0.001 mass % to 1 mass %.

Examples of the chelating agents include polyaminocarboxylic acids, oxycarboxylic acids, and phosphate.

The additive amount of the chelating agent is preferably 0.1 mass % to 10.0 mass %, and more preferably 0.1 mass % to 1 mass %. When the additive amount is too large, the cleaning effect may be lost and the cost becomes more expensive. When the additive amount is too small, the chelating agent cannot completely trap alkali earth metal ion in water, and the cleaning effect of the surfactant may be inhibited.

For the organic solvents, a volatile organic solvent of which the boiling point does not exceed 120° C. is suitable. The organic solvent having high boiling point may be difficultly removed from the medium.

Examples of the organic solvents include those having the boiling point of 120° C. or less such as isopropyl alcohol, ethanol, and methanol. The additive amount thereof is preferably 0.1 mass % to 60.0 mass %, and more preferably 10 mass % to 50 mass %. Thus, the high viscous smear such as grease can be removed. When the additive amount is too large, the reversible thermosensitive recording medium may be damaged. When the additive amount is too small, the organic solvent may not effectively work.

<Rinsing Step>

The rinsing step is the step of rinsing the cleaned reversible thermosensitive recording medium with either water or a mixture of water and the volatile organic solvent having the boiling point of 120° C. or less, <Cleaning Apparatus>

The method for cleaning the reversible thermosensitive recording medium of the present invention is carried out by applying the cleaning solution to the reversible thermosensitive recording medium. The cleaning solution is applied to the reversible thermosensitive recording medium in a manner that the reversible thermosensitive recording medium is immersed in a reservoir containing the cleaning solution, by spraying the cleaning solution by means of a waterjet, a brush, a sponge or the like. Alternatively, the surface of the reversible thermosensitive recording medium is wiped with a cleaning member which is moistened with the cleaning solution, or the reversible thermosensitive recording medium is contacted with the cleaning member which is immersed in the cleaning solution. Examples of the cleaning members include a belt made of fiber cloth, nonwoven cloth, and water-absorbing material, a brush, a winded roll, a block, and a blade.

The cleaned reversible thermosensitive recording medium is dried by wind, or dry air at 50° C. to 100° C. The cleaning time is the time of contacting the cleaning solution, and preferably 10 seconds to 180 seconds. When the cleaning time is short, the cleaning is not effective. When the cleaning time is long, the surface deterioration is progressed, which may cause a problem in durability.

For the cleaning apparatus, a cleaning apparatus by JCM Co., Ltd. (released in Sep. 2004) can be used (See FIG. 1).

FIG. 1 shows a vessel containing the cleaning solution 1, a brush 2, a blade 3, a sponge 4, a fan 5, and a cleaning apparatus 10.

Figure 2:
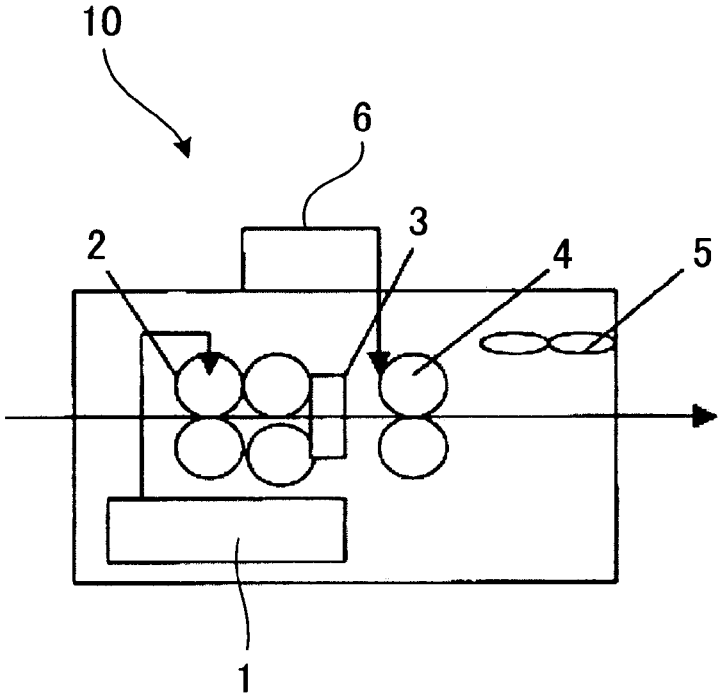
FIG. 2 schematically shows an example of the cleaning apparatus used in Examples of the present invention.

In the cleaning apparatus 10 shown in FIG. 1, a water shower 6 is set after cleaning, which can remove the cleaning solution (See FIG. 2).

FIG. 2 shows a vessel containing the cleaning solution 1, a brush 2, a blade 3, a sponge 4, a fan 5, and a cleaning apparatus 10.

By rinsing after cleaning, the cleaning solution remained on the surface of the reversible thermosensitive recording medium can be removed, and then sticky on the surface of the reversible thermosensitive recording medium can be further reduced.

In addition, after cleaning or rinsing, the cleaning solution can be removed and the reversible thermosensitive recording medium is dried by the combination of air, warm air, a wiping roll, a wiping sponge and the like.

Figure 3:
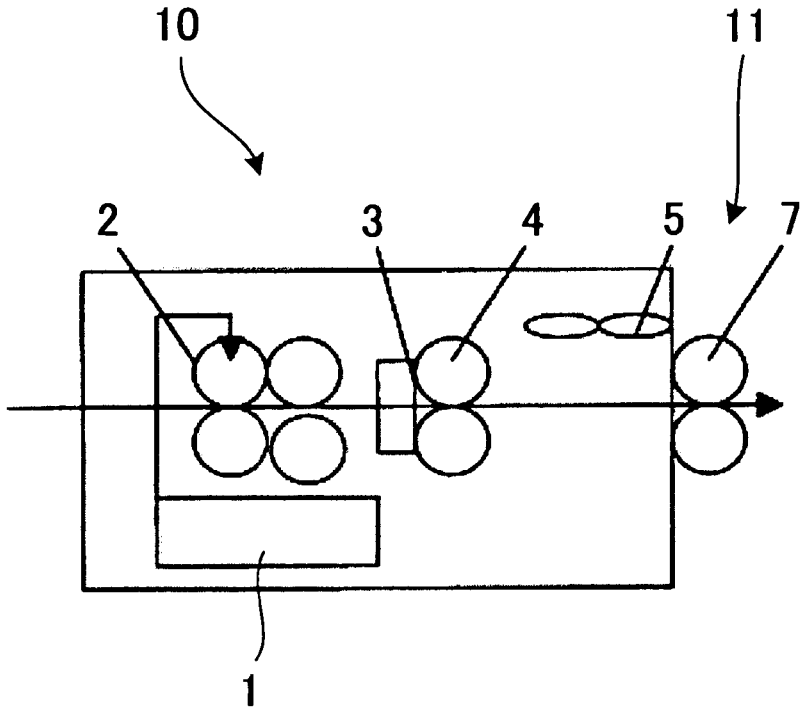
FIG. 3 schematically shows an example of the cleaning apparatus used in Examples of the present invention.

In the cleaning apparatus 10, an erasing part 11 is provided by setting a heat roll 7 having the temperature of 140° C. to 180° C., thereby the image on the reversible thermosensitive recording medium can be erased while drying (See FIG. 3).

FIG. 3 shows a vessel containing the cleaning solution 1, a brush 2, a blade 3, a sponge 4, a fan 5, and a cleaning apparatus 10.

A printer, by Panasonic Communications Co., Ltd. (released in September 2005), equipped with an erasing part 11 composed of a heat roll 7 and a recording part 12 containing a print heat 8, is set in the outlet of the cleaning apparatus 10 to erase and print an image continuously. Thus, the image on the reversible thermosensitive recording medium can be erased while drying and an image can be formed without influenced by smear (See FIG. 4).

Figure 4:
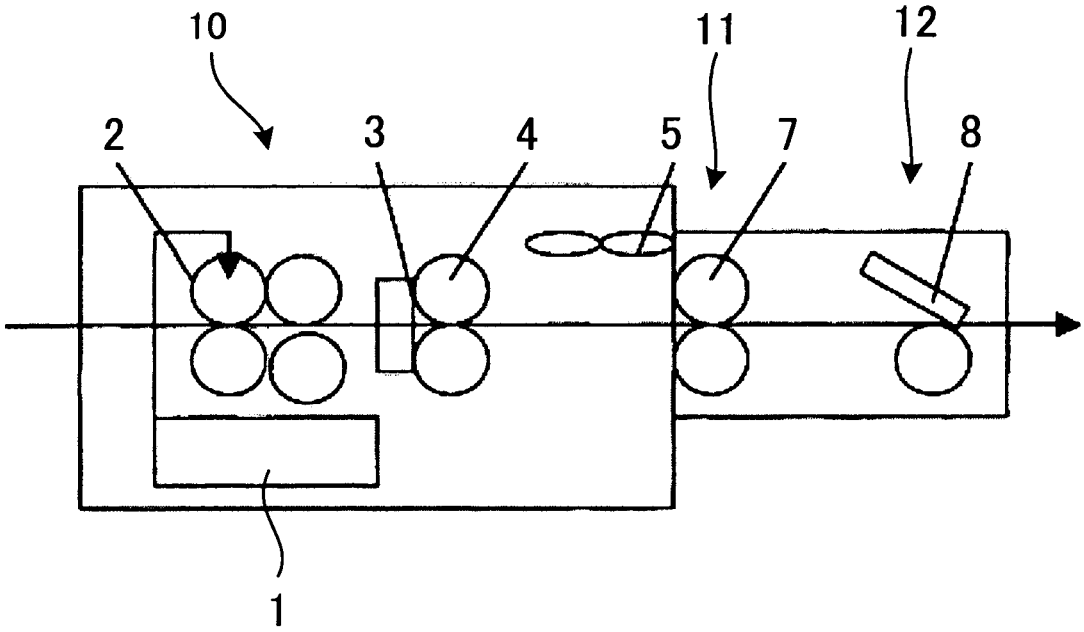
FIG. 4 schematically shows an example of the cleaning apparatus used in Examples of the present invention.

FIG. 4 shows a vessel containing the cleaning solution 1, a brush 2, a blade 3, a sponge 4, a fan 5, and a cleaning apparatus 10.

<<Image Processing Method>>

An image processing method of the invention contains at least any one of an image forming step which forms an image on a reversible thermosensitive recording medium by heating the reversible thermosensitive recording medium, and an image erasing step which erases the image formed on the reversible thermosensitive recording medium by heating the reversible thermosensitive recording medium.

The reversible thermosensitive recording medium is cleaned by the method for cleaning of the present invention.

The image forming step is the step of forming an image by heating the reversible thermosensitive recording medium, and carried out by an image forming unit. The image erasing step is the step of erasing an image by heating the reversible thermosensitive recording medium, and carried out by an image erasing unit.

The image forming unit is not particularly limited, and may be appropriately selected depending on the intended purpose. Examples thereof include a thermal head, and a laser. These may be used alone or in combination.

The image erasing unit is not particularly limited, and may be appropriately selected depending on the intended purpose. Examples thereof include a hot stamp, a ceramic heater, a heat roller, a heat block, hot blow, a thermal head, and a laser irradiation apparatus.

In the case that the reversible thermosensitive recording member (card) contains the thermosensitive recording layer and information memorizing part, a reading unit and rewriting unit for the memories in the information memorizing part are contained in the above-noted apparatus.

The image processing process preferably further contains conveying step and controlling step. The conveying step is carried out by a conveying unit. The conveying unit is not particularly limited, and may be appropriately selected depending on the intended purpose, provided that the conveying unit configured to convey the reversible thermosensitive recording medium successively. Examples thereof include a conveying belt, a conveying roller, and the combination of a conveying belt and a conveying roller.

The controlling step is carried out by a controlling unit. The controlling unit is not particularly limited, and may be appropriately selected depending on the intended purpose, provided that the controlling unit configured to control the respective steps. Examples thereof include devices such as a sequencer, and a computer.

EXAMPLES

Hereinafter, the constitution and effect of the present invention will be described by means of Examples and Comparative Examples, but it will be understood that the present invention is not construed as being limited thereto.

The test method of the Examples and Comparative Examples are as follows:

<Test Method>

The cycle of "smear→clean→erase an image→print an image" was carried out 500 times.

(1) Reversible Thermosensitive Recording Medium

A reversible thermosensitive recording medium, A5 size sheet, 630BF by Ricoh Company Ltd. was used. The reversible thermosensitive recording medium contained a leuco dye containing a fluorine compound as an electron-donating coloring compound, and a coloring agent containing a phenol compound having an amide group as an electron-accepting compound in a reversible thermosensitive recording layer.

(2) Smear

A mixture of 0.1 cc of cottonseed oil, and red water-color ink by Mitsubishi Pencil Co., Ltd. were attached to the reversible thermosensitive recording medium as smear. However, chassis grease was used in Example 19.

(3) Cleaning Apparatus

A cleaning apparatus by JCM Co., Ltd. (area length of cleaning solution of 170 mm, contact time of 15±5 sec. See FIG. 1), and a converted cleaning apparatus equipped with a rinsing unit, an erasing image unit, and a printing unit (See FIGS. 2 to 4) were used. A cleaning solution was changed at 500 passes.

(4) Erasing Image Apparatus

RSP-2 (speed 48 mm/sec to 52 mm/sec) by Panasonic Communications Solutions Co., Ltd. was used to erase a printed image.

Example 1

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass % (diluted with ion-exchange water)

Component: NOIGEN YX-400 (nonionic polyoxyethylene (n=40) lauryl ether by Dai-ichi Kogyo Seiyaku Co., Ltd.)

Example 2

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: NOIGEN YX-400 (nonionic polyoxyethylene (n=40) lauryl ether by Dai-ichi Kogyo Seiyaku Co., Ltd.)

Number of cleaning: 12 times (approximately 180 sec.)

Example 3

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: NOIGEN YX-400 (nonionic polyoxyethylene (n=40) lauryl ether by Dai-ichi Kogyo Seiyaku Co., Ltd.)

Number of cleaning: 4 times (approximately 60 sec.)

Example 4

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: PEGNOL HC-20 (nonionic polyoxyethylene (n=20) hydrogenated castor oil by Toho Chemical Industry Co., Ltd.)

Example 5

The test was carried out using a reversible thermosensitive recording medium, A5 size sheet, 630BF by Ricoh Company Ltd. according to the following condition and cleaning solution.

-Cleaning Solution-

Temperature: 25° C.

Density: 0.1 mass %

Component: LIPOLAN LJ-441 (anionic α-olefin sodium sulfonate by LION CORPORATION)

Example 6

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: SY-Glyster ML750 (nonionic decaglycerin monolaurate by Sakamoto Yakuhin Kogyo Co., Ltd.)

Example 7

The test was carried out using a reversible thermosensitive recording medium, A5 size sheet, 630BF by Ricoh Company Ltd. according to the following condition and cleaning solution.

-Cleaning SolutionpH: 6

Temperature: 25° C.

Density: 1 mass %

Component: SORBON T-80 (nonionic polyoxyethylene (n=20) sorbitan monooleate by Toho Chemical Industry Co., Ltd.)

Example 8

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component; PEGNOL O-20 (nonionic polyoxyethylene (n=20) oleyl ether by Toho Chemical Industry Co., Ltd.)

Example 9

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: Mydol 12 (nonionic lauryl glucoside by Kao Corporation)

Example 10

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: Alscope DA-330S (anionic polyoxyethylene (n=3) alkyl (C12-C13) ether sodium sulfate by Toho Chemical Industry Co., Ltd.)

Example 11

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: NEWREX R (anionic sodium dodecylbenzenesulfonate by NOF CORPORATION)

Example 12

The test was carried out using a reversible thermosensitive recording medium, A5 size sheet, 630BF by Ricoh Company Ltd. according to the following condition and cleaning solution.

-Cleaning Solution-

Temperature: 50° C.

Density: 1 mass %

Component: NEWREX R (anionic sodium dodecylbenzenesulfonate by NOF CORPORATION)

Example 13

The test was carried out using a reversible thermosensitive recording medium, A5 size sheet, 630BF by Ricoh Company Ltd. according to the following condition and cleaning solution.

-Cleaning Solution-

Temperature: 5° C.

Density: 1 mass %

Component: LIPOLAN LJ-441 (anionic α-olefin sodium sulfonate by LION CORPORATION)

Example 14

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: LIPOLAN LJ-441 (anionic α-olefin sodium sulfonate by LION CORPORATION)

Example 15

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: LIPOLAN LJ-441 (anionic α-olefin sodium sulfonate by LION CORPORATION)

Number of cleaning: 12 times (approximately 180 sec.)

Example 16

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: LIPOLAN LJ-441 (anionic α-olefin sodium sulfonate by LION CORPORATION)

Number of cleaning: 4 times (approximately 60 sec.)

Example 17

The test was carried out using a reversible thermosensitive recording medium, A5 size sheet, 630BF by Ricoh Company Ltd. according to the following condition and cleaning solution.

-Cleaning Solution-
Temperature: 25° C.
Density: 30 mass %
Component: LIPOLAN LJ-441 (anionic α-olefin sodium sulfonate by LION CORPORATION)

Example 18

The test was carried out using a reversible thermosensitive recording medium, A5 size sheet, 630BF by Ricoh Company Ltd. according to the following condition and cleaning solution.
-Cleaning Solution-
Temperature: 25° C.
Density: 1 mass %
Component: LIPOLAN LJ-441 (anionic α-olefin sodium sulfonate by LION CORPORATION)
a cross-linked acrylic acid polymer as a thickener (Highbiswako 104 by Wako Pure Chemical Industries, Ltd.) 0.08 mass %
diisopropanolamine as a neutralizing agent 0.12 mass %

Example 19

The test was carried out using a reversible thermosensitive recording medium, A5 size sheet, 630BF by Ricoh Company Ltd. and 0.01 mg of chassis grease as smear according to the following condition and cleaning solution.
-Cleaning Solution-
Temperature: 25° C.
Density: 1 mass %
Component: LIPOLAN LJ-441 (anionic α-olefin sodium sulfonate by LION CORPORATION)
Isopropyl alcohol 20 mass %

Example 20

The test was carried out using a reversible thermosensitive recording medium, A5 size sheet, TRF135WA by Mitsubishi Paper Mills Limited according to the following condition and cleaning solution. The reversible thermosensitive recording medium contained a leuco dye containing a fluorine compound as an electron-donating coloring compound, and a coloring agent containing a phenol compound having a hydrazide as an electron-accepting compound.
-Cleaning Solution-
Temperature: 25° C.
Density: 1 mass %
Component: LIPOLAN LJ-441 (anionic α-olefin sodium sulfonate by LION CORPORATION)

Example 21

The test was carried out using a reversible thermosensitive recording medium, A5 size sheet, 630BF by Ricoh Company Ltd. according to the following condition and cleaning solution.
-Cleaning Solution-
Temperature: 25° C.
Density: 1 mass %
Component: LUNOX S-40T (anionic triethanolamine dodecylbenzenesulfonate by Toho Chemical Industry Co., Ltd.)

Example 22

The test was carried out using a reversible thermosensitive recording medium, A5 size sheet, 630BF by Ricoh Company Ltd. according to the following condition and cleaning solution.
-Cleaning Solution-
Temperature: 25° C.
Density: 1 mass %
Component: PHOSPHANOL ML-220 (anionic polyoxyethylene (n=2) lauryl ether phosphate by Toho Chemical Industry Co., Ltd.)

Example 23

The test was carried out using a reversible thermosensitive recording medium, A5 size sheet, 630BF by Ricoh Company Ltd. and the cleaning solution used in Example 14 according to the following condition of the cleaning apparatus. Ion-exchanged water was used as a rinse solution.
-Cleaning Apparatus-
The converted cleaning apparatus shown as FIG. 2.

Example 24

The test was carried out using a reversible thermosensitive recording medium, A5 size sheet, 630BF by Ricoh Company Ltd. and the cleaning solution used in Example 14 according to the following condition of the cleaning apparatus.
-Cleaning Apparatus-
The converted cleaning apparatus shown as FIG. 3. (an erasing unit was a fixing unit of imagio PPC by Ricoh Company Ltd.)

Example 25

The test was carried out using a reversible thermosensitive recording medium, A5 size sheet, 630BF by Ricoh Company Ltd. and the cleaning solution used in Example 14 according to the following condition of the cleaning apparatus.
-Cleaning Apparatus-
The converted cleaning apparatus shown as FIG. 4. (an erasing unit was a unit of erasing a printed image of RSP-2by Panasonic Communications Solutions Co., Ltd.)

Example 26

The test was carried out using a reversible thermosensitive recording medium, A5 size sheet, 630BF by Ricoh Company Ltd. according to the following condition and cleaning solution.
-Cleaning Solution-
Temperature: 25° C.
Density: 1 mass %
Component: AIRROLL CT-1 (anionic sodium dioctyl sulfosuccinate by Toho Chemical Industry Co., Ltd.)

Comparative Example 1

The test was carried out using a reversible thermosensitive recording medium, A5 size sheet, 630BF by Ricoh Company Ltd. according to the following condition and cleaning solution.
-Cleaning Solution-
Temperature: 25° C.
Cleaning solution: ion-exchanged water alone Comparative Example 2

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: Catinal AEAS (cationic diethylaminoethylamide stearate by Toho Chemical Industry Co., Ltd.)

Comparative Example 3

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: Catinal MB-50A (cationic benzalkonium chloride by Toho Chemical Industry Co., Ltd.)

Comparative Example 4

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: Catinal LTC-35A (cationic lauryl trimethyl ammonium chloride by Toho Chemical Industry Co., Ltd.)

Comparative Example 5

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: OBAZOLINE AHS-103 (amphoteric lauryl sulfobetaine by Toho Chemical Industry Co., Ltd.)

Comparative Example 6

The test was carried out using a reversible thermosensitive recording medium, A5 size sheet, 630BF by Ricoh Company Ltd. according to the following condition and cleaning solution.

-Cleaning Solution-

Temperature: 25° C.

Density: 1 mass %

Component: OBAZOLINE 516S (amphoteric polyoctylpolyaminoethylglycine by Toho Chemical Industry Co., Ltd.)

Next, the performance evaluation of Examples and Comparative Examples was carried out as follows. The results are shown in Table 1.

<Evaluation Method>

The print density, background density, head malfunction, crack change, and surface smear before the test and after 500 cycles tested were measured as the following (1) to (3), and compared.

(1) print density and background density: They were measured by Macbeth densitometer.

(2) head malfunction: The corrosion of the print head was visually observed.

(3) crack change

The crack is the surface of a sheet which is folded back by 1 mm in diameter. The crack change is the level of image void in the crack part. The crack change was evaluated based on the following criteria.

[Evaluation Criteria]

Small: image void of 0.1 mm-width or less

Medium: image void about 0.2 mm-width

Large: image void of 0.3 mm-width or more

Extra Large: overall image void (4) Surface smear: Smear was visually observed.

TABLE 1

| | Medium | Surfactant | Option | Temperature (° C.) | Density (mass %) | Repeated print density | Repeated background density | Head malfunction | Crack change | Surface smear |
|---|---|---|---|---|---|---|---|---|---|---|
| Ex. 1 | 630BF | NOIGEN YX-400 nonionic | — | 25 | 1 | 1.4/0.8 | 0.1/0.2 | None | Medium | None |
| Ex. 2 | 630BF | NOIGEN YX-400 nonionic | — | 25 | 1 | 1.4/0.7 | 0.1/0.3 | None | Large | None |
| Ex. 3 | 630BF | NOIGEN YX-400 nonionic | — | 25 | 1 | 1.4/0.8 | 0.1/0.2 | None | Medium | None |
| Ex. 4 | 630BF | PEGNOL HC-20 nonionic | — | 25 | 1 | 1.4/0.8 | 0.1/0.3 | None | Medium | None |
| Ex. 5 | 630BF | LIPOLAN LJ-441 anionic | — | 25 | 0.01 | 1.4/1.0 | 0.1/0.1 | None | Small | A little |
| Ex. 6 | 630BF | SY-Glyster ML750 nonionic | — | 25 | 1 | 1.4/0.9 | 0.1/0.1 | None | Large | None |
| Ex. 7 | 630BF | SORBON T-80 nonionic | — | 25 | 1 | 1.4/0.8 | 0.1/0.1 | None | Medium | None |
| Ex. 8 | 630BF | PEGNOL O-20 nonionic | — | 25 | 1 | 1.4/0.8 | 0.1/0.1 | None | Medium | None |
| Ex. 9 | 630BF | Mydol 12 nonionic | — | 25 | 1 | 1.4/0.8 | 0.1/0.2 | None | Medium | None |
| Ex. 10 | 630BF | Alscope DA-330S anionic | — | 25 | 1 | 1.4/1.1 | 0.1/0.2 | None | Small | None |
| Ex. 11 | 630BF | NEWREX R anionic | — | 25 | 1 | 1.4/1.1 | 0.1/0.2 | None | Small | None |
| Ex. 12 | 630BF | NEWREX R anionic | — | 50 | 1 | 1.4/0.9 | 0.1/0.2 | None | Medium | None |
| Ex. 13 | 630BF | LIPOLAN LJ-441 anionic | — | 5 | 1 | 1.4/1.1 | 0.1/0.2 | None | Small | A little |

TABLE 1-continued

| | Medium | Surfactant | Option | Temperature (° C.) | Density (mass %) | Repeated print density | Repeated background density | Head malfunction | Crack change | Surface smear |
|---|---|---|---|---|---|---|---|---|---|---|
| Ex. 14 | 630BF | LIPOLAN LJ-441 anionic | — | 25 | 1 | 1.4/0.9 | 0.1/0.1 | None | Small | None |
| Ex. 15 | 630BF | LIPOLAN LJ-441 anionic | — | 25 | 1 | 1.4/0.8 | 0.1/0.1 | None | Medium | None |
| Ex. 16 | 630BF | LIPOLAN LJ-441 anionic | — | 25 | 1 | 1.4/0.9 | 0.1/0.1 | None | Small | None |
| Ex. 17 | 630BF | LIPOLAN LJ-441 anionic | — | 25 | 30 | 1.4/1.1 | 0.1/0.1 | None | Medium | None |
| Ex. 18 | 630BF | LIPOLAN LJ-441 anionic | Additive | 25 | 1 | 1.4/1.1 | 0.1/0.1 | None | Small | None |
| Ex. 19 | 630BF | LIPOLAN LJ-441 anionic | Isopropyl alcohol | 25 | 1 | 1.4/1.0 | 0.1/0.1 | None | Small | None grease removed |
| Ex. 20 | TRF135 WA | LIPOLAN LJ-441 anionic | — | 25 | 1 | 1.4/0.8 | 0.1/0.1 | None | Small | None |
| Ex. 21 | 630BF | LUNOX S-40T anionic | — | 25 | 1 | 1.4/0.9 | 0.1/0.1 | None | Small | None |
| Ex. 22 | 630BF | PHOSPHANOL ML-220 anionic | — | 25 | 1 | 1.4/0.8 | 0.1/0.1 | None | Small | None |
| Ex. 23 | 630BF | LIPOLAN LJ-441 anionic | — | 25 | 1 | 1.4/1.0 | 0.1/0.1 | None | Small | None |
| Ex. 24 | 630BF | LIPOLAN LJ-441 anionic | — | 25 | 1 | 1.4/0.9 | 0.1/0.1 | None | Small | None |
| Ex. 25 | 630BF | LIPOLAN LJ-442 anionic | — | 25 | 1 | 1.4/0.9 | 0.1/0.1 | None | Small | None |
| Ex. 26 | 630BF | AIRROLL CT-1 anionic | — | 25 | 1 | 1.4/0.9 | 0.1/0.1 | None | Small | A little |
| Comp. Ex. 1 | 630BF | None | — | 25 | — | 1.4/reduction of print density | 0.1/— | Smear | — | — |
| Comp. Ex. 2 | 630BF | Catinal AEAS cationic | — | 25 | 1 | 1.4/reduction of print density | 0.1/— | Corrosion | — | — |
| Comp. Ex. 3 | 630BF | Catinal MB-50A cationic | — | 25 | 1 | 1.4/reduction of print density | 0.1/— | Corrosion | — | — |
| Comp. Ex. 4 | 630BF | Catinal LTC-35A cationic | — | 25 | 1 | 1.4/reduction of print density | 0.1/— | Corrosion | — | — |
| Comp. Ex. 5 | 630BF | OBAZOLINE AHS-103 amphoteric | — | 25 | 1 | 1.4/0.7 | 0.1/0.2 | A littie corrosion | Large | None |
| Comp. Ex. 6 | 630BF | OBAZOLINE 516S amphoteric | — | 25 | 1 | 1.4/0.4 | 0.1/0.3 | A littie corrosion | Extra Large | None |

From the result of Table 1, comprehensive evaluation of repeated print density, repeated background density, head malfunction, and crack change in Examples after the test was superior to that in the Comparative Examples after the test.

The test result in Table 1 was obtained when the cycle of "smear→clean→erase an image→print an image" was carried out 500 times. However, same tendency was observed in the cycle of 300 times according to the sampling test during the process.

The method for cleaning a reversible thermosensitive recording medium of the present invention can clean oil spot and marking with a marker or pencil on a reversible thermosensitive recording medium without reducing printing function. As a result, the reversible thermosensitive recording medium can be repeatedly used. Particularly, the method for cleaning a reversible thermosensitive recording medium of the present invention is suited for a method for cleaning a data carrier which is used for a tag for process quality control, and physical distribution management in an industrial plant.

What is claimed is:

1. A method for cleaning a reversible thermosensitive recording medium that comprises a protective layer of a thickness in a range of 0.1 μm to 10 μm, said method comprising:

cleaning the reversible thermosensitive recording medium with a cleaning solution comprising a nonionic surfactant, wherein the nonionic surfactant in the cleaning solution is at least one selected from the group consisting of polyoxyethylene fatty alcohol ether, polyoxyethylene sorbitan fatty acid ester, polyoxyethylene castor oil, polyoxyethylene hydrogenated castor oil, polyglycerin fatty acid ester, and alkyl polyglucoside, wherein the nonionic surfactant in the cleaning solution includes laurel glucoside, and wherein the reversible thermosensitive recording medium comprises an electron-donating coloring compound and an electron-accepting compound and reversibly changes any one of transparency and color tone depending on temperature.

2. A method for cleaning a reversible thermosensitive recording medium according to claim 1, wherein the content of the nonionic surfactant in the cleaning solution is 0.01 mass % to 30 mass %.

3. A method for cleaning a reversible thermosensitive recording medium according to claim 1, wherein the temperature of the cleaning solution when used is 5° C. to 50 ° C.

4. A method for cleaning a reversible thermosensitive recording medium according to claim 1, wherein the contact time of the reversible thermosensitive recording medium with the cleaning solution is 10 seconds to 120 seconds.

5. A method for cleaning a reversible thermosensitive recording medium according to claim 1, wherein the cleaning solution further comprises at least one selected from an additive, a thickener, an anti-foaming agent, and a chelating agent.

6. A method for cleaning a reversible thermosensitive recording medium according to claim 1, wherein the cleaning solution comprises a volatile organic solvent having the boiling point of 120° C. or less.

7. A method for cleaning a reversible thermosensitive recording medium according to claim 1, further comprising rinsing the cleaned reversible thermosensitive recording medium with water or a mixture of water and a volatile organic solvent having the boiling point of 120° C. or less.

8. The method according to claim 1, wherein the nonionic surfactant in the cleaning solution includes an lauryl glucoside.

9. An image processing method comprising at least one of:

forming an image on a reversible thermosensitive recording medium that comprises a protective layer of a thickness in a range of 0.1 μm to 10 μm, by heating the reversible thermosensitive recording medium, and erasing the image formed on the reversible thermosensitive recording medium by heating the reversible thermosensitive recording medium, wherein the reversible thermosensitive recording medium is cleaned by a method for cleaning the reversible thermosensitive recording medium, which comprises cleaning the reversible thermosensitive recording medium with a cleaning solution comprising a nonionic surfactant, wherein the nonionic surfactant in the cleaning solution is at least one selected from the group consisting of polyoxyethylene fatty alcohol ether, polyoxyethylene sorbitan fatty acid ester, polyoxyethylene castor oil, polyoxyethylene hydrogenated castor oil, polyglycerin fatty acid ester, and alkyl polyglucoside, wherein the nonionic surfactant in the cleaning solution includes lauryl glucoside, and wherein the reversible thermosensitive recording medium comprises an electron-donating coloring compound and an electron-accepting compound and reversibly changes any one of transparency and color tone depending on temperature.

10. A method for cleaning a reversible thermosensitive recording medium comprising a protective layer of a thickness in a range of 0.1 μm to 10 μm, said method comprising:

cleaning a reversible thermosensitive recording medium with a cleaning solution comprising a nonionic surfactant, wherein the nonionic surfactant in the cleaning solution is at least one selected from the group consisting of polyoxyethylene fatty alcohol ether, polyoxyethylene sorbitan fatty acid ester, polyoxyethylene castor oil, polyoxyethylene hydrogenated castor oil, polyglyerrin fatty acid ester, and alkyl polyglucoside, wherein the nonionic surfactant in the cleaning solution includes lauryl glucoside, and wherein the reversible thermosensitive recording medium reversibly changes any one of transparency and color tone depending on temperature.

* * * * *